US006208743B1

(12) United States Patent
Marten et al.

(10) Patent No.: US 6,208,743 B1
(45) Date of Patent: Mar. 27, 2001

(54) ELECTRODYNAMIC ACOUSTIC TRANSDUCER WITH MAGNETIC GAP SEALING

(75) Inventors: Stefan Marten, Wedemark; Rainer Wiggers, Ahlden Ot Eilte, both of (DE)

(73) Assignee: Sennheiser Electronic GmbH & Co. K.G., Wedemark (DE)

( * ) Notice: Subject to any disclaimer, the term of this patent is extended or adjusted under 35 U.S.C. 154(b) by 0 days.

(21) Appl. No.: 08/820,487

(22) Filed: Mar. 18, 1997

(30) Foreign Application Priority Data

Mar. 21, 1996 (DE) ..... 196 10 997

(51) Int. Cl.[7] ..... H04R 1/00
(52) U.S. Cl. ..... 381/415; 381/430; 381/412
(58) Field of Search ..... 381/397, 396, 381/398, 400, 412, 411, 413, 414, 415, 423, 424, 430, 432

(56) References Cited

U.S. PATENT DOCUMENTS

| | | | | |
|---|---|---|---|---|
| 4,017,694 | | 4/1977 | King . | |
| 4,320,263 | | 3/1982 | Thiele . | |
| 4,361,879 | | 11/1982 | Dubbelday et al. . | |
| 4,414,437 | * | 11/1983 | Trauernicht et al. | 381/415 |
| 4,896,754 | * | 1/1990 | Carlson et al. | 192/21.5 |
| 5,062,140 | * | 10/1991 | Inanaga et al. | 381/415 |
| 5,243,662 | * | 9/1993 | Sogn et al. | 381/415 |
| 5,335,287 | * | 8/1994 | Athanas | 381/415 |
| 5,461,677 | | 10/1995 | Raj et al. . | |
| 5,757,946 | * | 5/1998 | Van Schyndel | 381/415 |
| 5,815,587 | * | 9/1998 | Lars Goller | 381/412 |

FOREIGN PATENT DOCUMENTS

| | | |
|---|---|---|
| 43 29 982 | 3/1995 | (DE) . |
| 0 344 975 | 12/1989 | (EP) . |
| 2 633 480 | 12/1989 | (FR) . |
| 236 313 | 7/1925 | (GB) . |
| 2 147 174 | 5/1985 | (GB) . |
| 56-161798 | 12/1981 | (JP) . |
| 94-274411 | 7/1994 | (JP) . |
| WO 96/13960 | 5/1996 | (WO) . |

OTHER PUBLICATIONS

Melillo and Raj "Ferrofluids as a Means of Controlling Woofer Design Parameters", May 15, 1978.*

* cited by examiner

*Primary Examiner*—Curtis A. Kuntz
*Assistant Examiner*—Rexford N Bamie
(74) *Attorney, Agent, or Firm*—Merchant & Gould P.C.

(57) ABSTRACT

An electrodynamic acoustic transducer with a coil which projects into an air gap subject to an electromagnetic field, wherein an acoustic short circuit is prevented. The electrodynamic transducer has a membrane comprising two differently profiled portions, an acoustically effective central portion with a convexity in form of a spherical cap, and a ring-shaped bead which borders the central portion and serves to elastically support the membrane. The ring-shaped bead is arranged beneath the central portion and extends radially inwards starting from a coil seat of the coil. The air gap is sealed by means of a liquid or solid medium, such as ferrofluid, such that an acoustic short circuit between the front volume and the rear volume of the transducer is prevented.

10 Claims, 4 Drawing Sheets

ELECTRODYNAMIC ACOUSTIC TRANSDUCER WITH MAGNETIC GAP SEALING

FIELD OF THE INVENTION

The invention relates to an electrodynamic acoustic transducer with a coil which projects into an air gap subject to an electromagnetic field.

BACKGROUND OF THE INVENTION

Such an electrodynamic acoustic transducer is known in many cases for example from German Patent No. P 43 29 982.2.

Such an electrodynamic acoustic transducer comprises a magnetic system and a vibration system which includes a membrane and a wire-wound coil supported by said membrane. The membrane being divided into two differently profiled portions, which have to perform different functions. Firstly, the membrane comprises an acoustically effective central portion with a convexity in the form of a cap, which is generally called a "spherical cap". This central portion is bordered by a coil seat which holds the electrical coil of the transducer. A ring portion for elastic support extends from the connection having for instance an arc shaped profile and being generally called "bead". If the bead extends in an outward direction, it is an electrodynamic acoustic transducer with an outward bead, if the bead is located beneath the central portion in an inward direction, it is a so called "transducer with inner bead" as described in P 43 29 982, wherein the coil seat not only forms the outer border of the central portion but also the border of the ring portion and defines the maximum outer diameter of the entire membrane.

Such a transducer with inner bead has the problem that there is an air connection between the volume which is located beneath the spherical cap—hereinafter called "rear volume"—and the area which is located in front of the spherical cap—hereinafter called "front volume". This can result in an acoustic short circuit with the consequence that the effective sound emission is substantially reduced. The sound being projected from the front side of the spherical cap is of opposition phase to the sound being projected from the rear side of the membrane. Across the air gap the two sounds add up and therefore mutually cancel each other out.

SUMMARY OF THE INVENTION

The object of the invention is to form an acoustic transducer of the type mentioned at the beginning wherein an acoustic short circuit is prevented.

According to the invention the problem is solved by means of an electrodynamic acoustic transducer with a coil which projects into an air gap subject to an electromagnetic field, whereby the air gap is sealed by means of a viscous or solid medium, for example a ferrofluid. The subclaims give a description of advantageous modifications of the invention.

Preferably the coil forms an inner and an outer air gap when projecting into the air gap, wherein the sealing medium is located in both air gaps, preferably however only in the outer air gap. The sealing of the air gap prevents the above mentioned addition which is particularly effectively achieved in the low frequency range.

BRIEF DESCRIPTION OF THE DRAWINGS

The invention will be described in more detail below using an embodiment which is shown in the drawings. The drawings show.

DETAILED DESCRIPTION OF PREFERRED EMBODIMENTS

Figure 1:
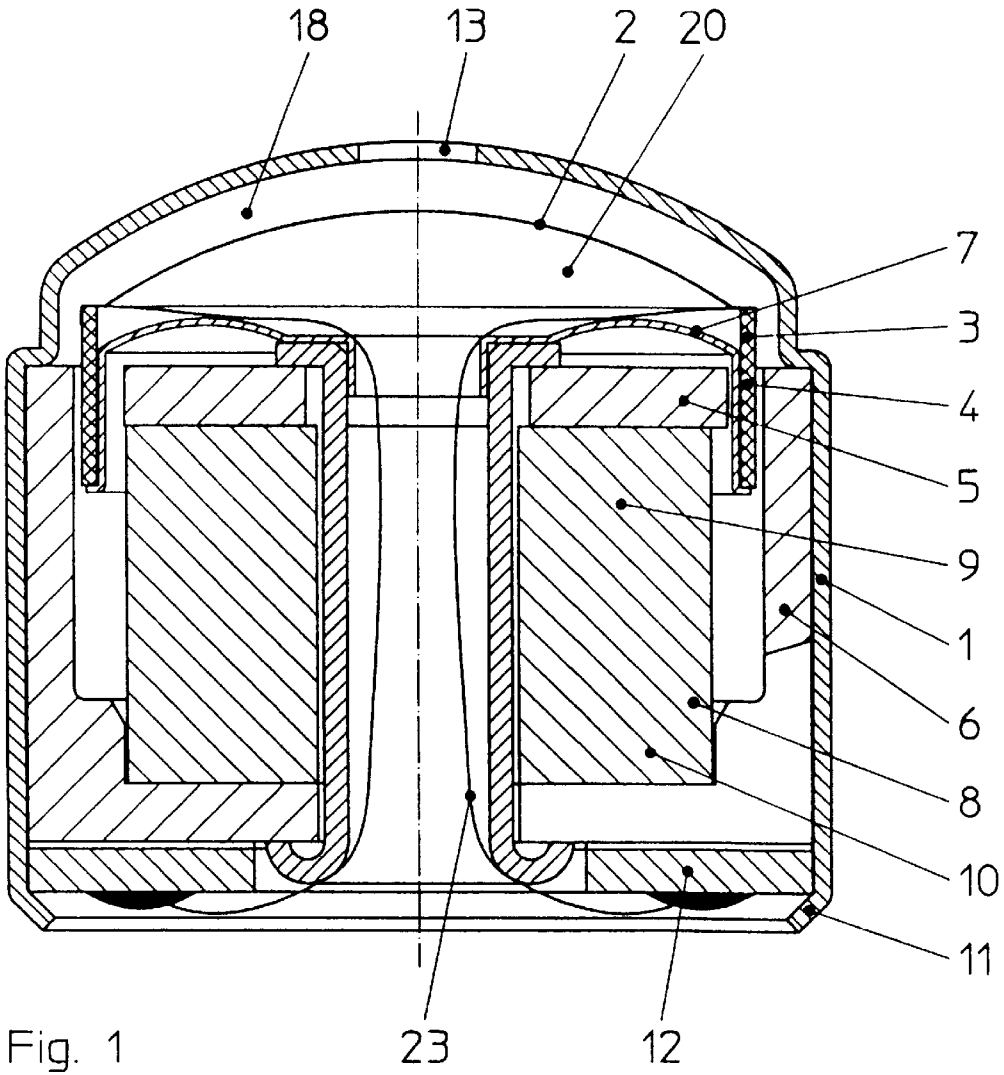
FIG. 1 a sectional view of a transducer with inner bead

FIG. 1 shows an electrodynamic acoustic transducer 1 with a membrane 2 which is fastened to a ring coil 3 and is formed in an air gap 4 between a pole flange 5 on the one side and a cup 6 on the other side. For mechanical support the ring coil is fastened to a bead 7 which is situated beneath the membrane, which is why the electrodynamic acoustic transducer shown in FIG. 1 is a so called transducer with inner bead. A magnet 8 with a magnetic north pole area 9 and a magnetic south pole area 10 is situated beneath the pole flange. External protection of the electrodynamic acoustic transducer is obtained by a housing 11 which is preferably made of aluminium. In the lower area of the housing a board 12 is situated which has an electric connection 23 with the coil 3. To project or receive sound the case comprises an aperture 13 which is directed in axial extension of the central portion of the membrane 2.

Figure 2:
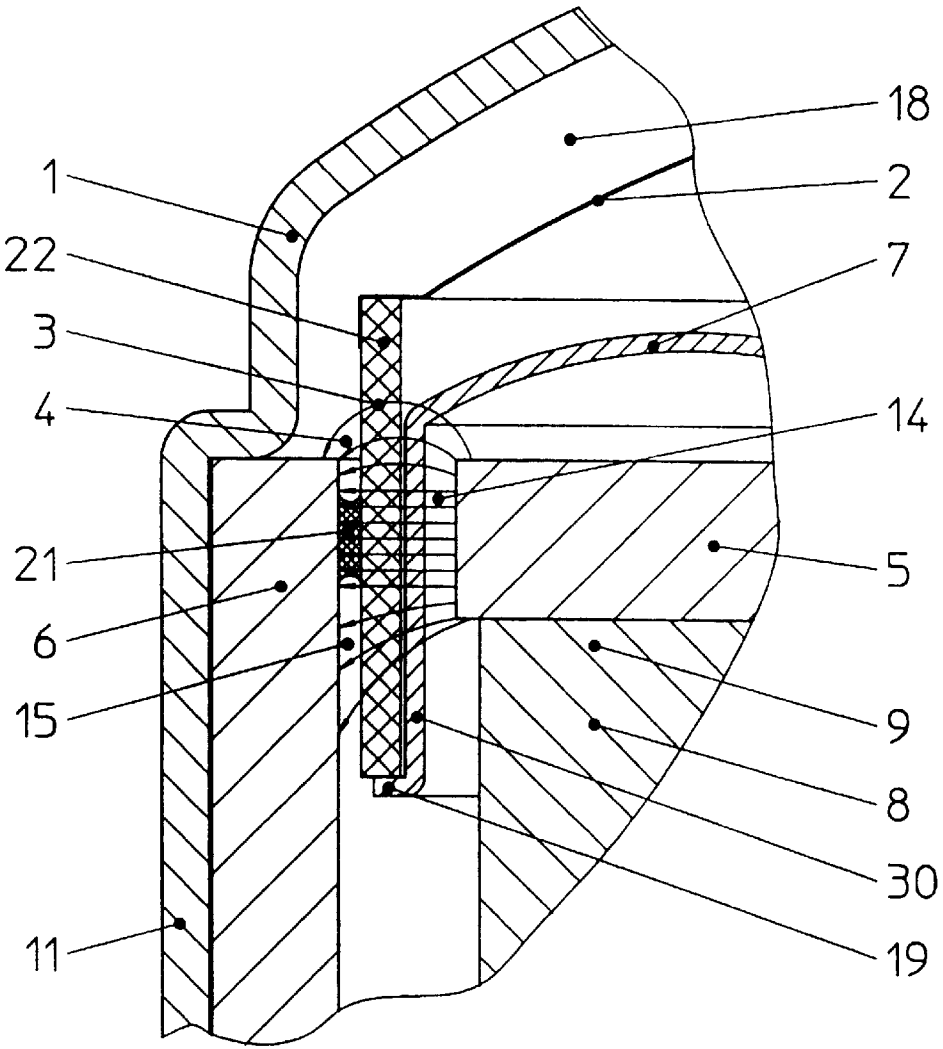
FIG. 2 an enlarged section of the transducer with inner bead as shown in FIG. 1

FIG. 2 shows the enlargement of a part of the electrodynamic acoustic transducer shown in FIG. 1. The same reference signs in FIG. 2 indicate the same parts with corresponding reference signs in FIG. 1.

Due to the projection of the coil 3 into the air gap 4 between the pole flange 5 and the cup 6 an inner air gap 14 and an outer air gap 15 are formed. The arrows in FIG. 2 show that magnetic flux lines 16 emerge from the pole flange and penetrate into the cup.

Furthermore a ferrofluid 21 is arranged as a viscous medium in the outer air gap 15. Ferrofluid is a material which can be penetrated by magnetic flux lines while, due to its properties, automatically trying to move towards the part of the air gap where the magnetic field strength is the highest. The viscous medium fills the outer air gap so that between the inner air gap 14 and the front volume 18 in front of the membrane 2 there ceases to be an air connection. The ferrofluid is a low viscous (highly liquid) material which allows the coil to move in the air gap without problems and does not interfere with the movement of the ring coil.

It is of course possible in a transducer with inner bead to additionally arrange the ferrofluid also in the inner air gap 14 in order to improve the sealing effect.

Furthermore, FIG. 2 shows that the bead which serves as elastic support of the membrane comprises a radially outwardly directed encircling edge 19 which supports the ring coil 3. From the encircling edge 19 a ring portion 30 i.e. the bead 7 initially extends in a parallel direction to the coil 3 and then bends in its upper area and is then fastened to a pole piece in the inner area of the electrodynamic acoustic transducer 1. The ring coil 3 and the bead 7 are glued or bonded to each other either only in the area of the radially encircling edge 19 and/or on additional points.

The membrane 2 is fastened to the opposite part of the ring coil 3 in the radially encircling edge 19, for example by gluing together an encircling edge 22 of the membrane with the coil 3.

Figure 3:
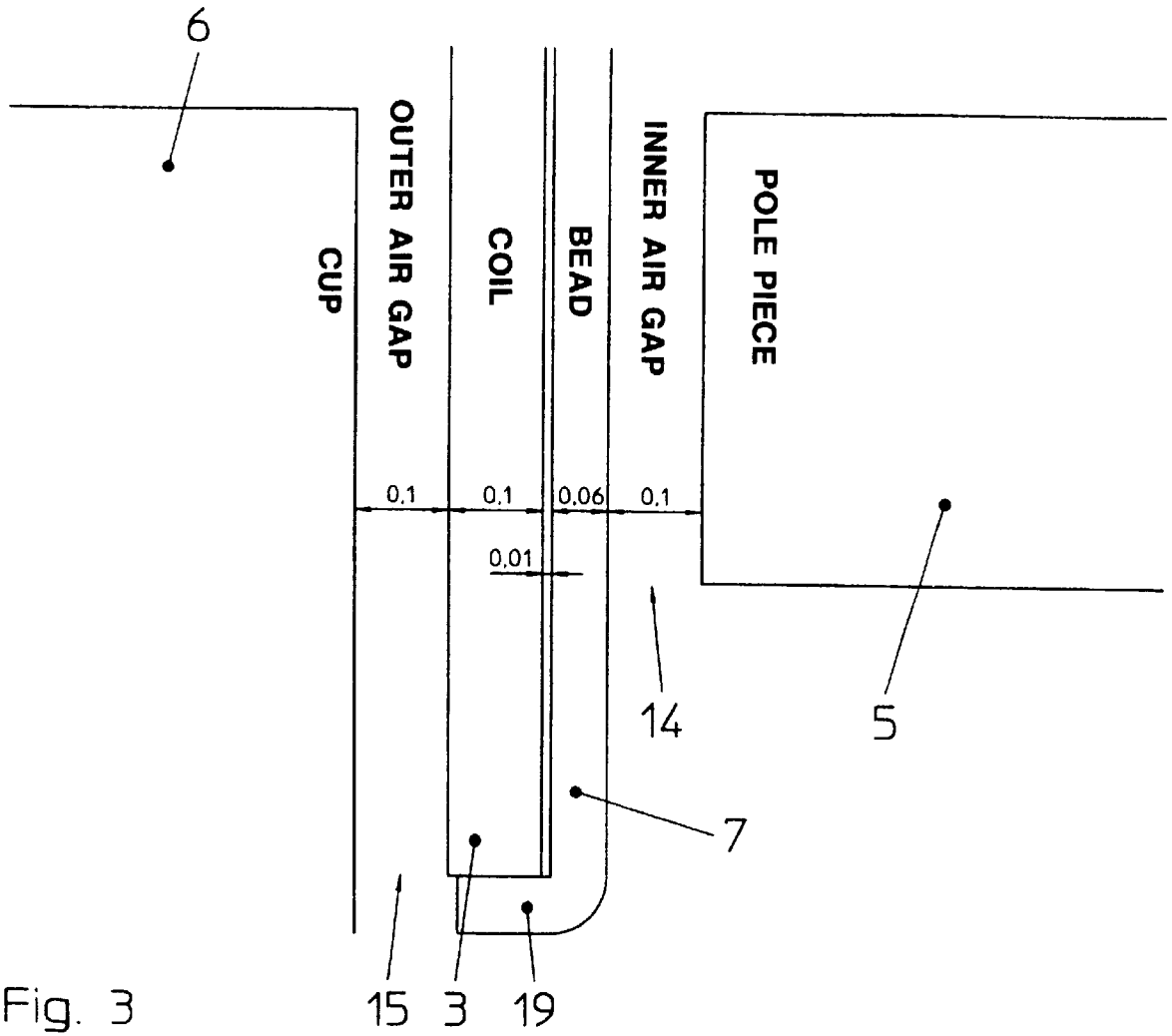
FIG. 3 a further enlargement of a part of the transducer with inner bead as shown in FIG. 1

FIG. 3 shows a further enlarged section of a part shown in FIG. 2. Here the shown numerals are to be understood as being dimensions given in millimetres i.e. the outer air gap 15 has with a thickness of 0.1 mm the same thickness as the ring coil 3 and the inner air gap, while the gap between the bead 7 and the coil is 0.01 mm and the bead itself has a thickness of 0.06 mm. It goes without saying that the measurements given in FIG. 3 are only an example. The invention is by no means restricted to these measurements.

By arranging a fluid or solid medium like ferrofluid in the outer air gap the latter is sealed and therefore the connection between the volume 20 behind the membrane 2 and the volume 18 in front of the membrane is prevented. Thus the sealing of the air gap prevents the occurrence of an acoustic short circuit across the air gap in a transducer with inner bead.

Figure 4:
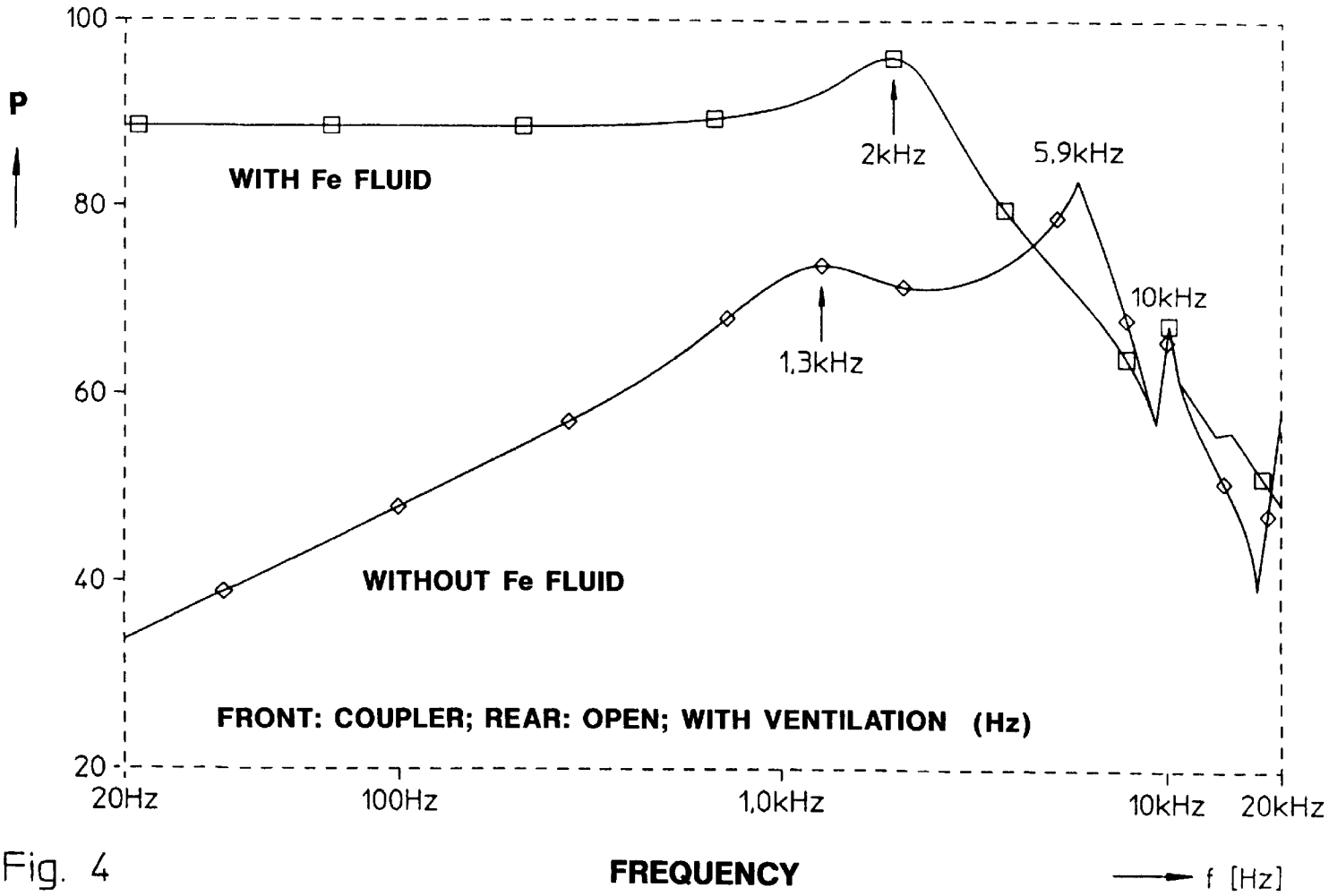
FIG. 4 a measuring diagram for an electrodynamic acoustic transducer according to the invention

A measurement example in FIG. 4 shows which consequences result from it. The upper curve shows what kind of acoustic pressures—ordinate—are obtained under certain frequencies—abscissa—with an electrodynamic acoustic transducer with an air gap sealing, i.e. with an acoustic barrier and the lower curve shows the course of the acoustic pressure with an electrodynamic acoustic transducer according to FIG. 1 without an air gap sealing. It is noticeable that particularly in the low frequency range the effects of the acoustic short circuit are dramatic, which results in a substantially reduced sound emission due to the above explained reasons.

The diagram in FIG. 4 also shows that in an electrodynamic acoustic transducer according to the invention being operated as a means for sound emission a nearly constant acoustic pressure gradient can be obtained over a large frequency range.

The described electrodynamic acoustic transducer particularly when formed as a transducer with inner bead can be particularly well arranged in a hearing aid or in headphones, whereby in the case of arranging it in a hearing aid it is advantageous when the hearing aid comprises a moveable ear tube for fitting in the human auditory passage. The ear tube is the part of the hearing aid which is arranged in the auditory passage of an inner ear. Due to the different forms of the auditory passage of a person the movability of the ear tube can allow individual adjustment.

What is claimed is:

1. Electrodynamic acoustic transducer comprising:

a coil which projects into an air gap formed between an inner surface of a cup and a surface of a pole flange, the coil being subject to an electromagnetic field, wherein the electrodynamic transducer has a membrane including two differently profiled portions, namely an acoustically effective central portion with a convexity in form of a spherical cap, and a ring-shaped bead which borders the central portion and serves to elastically support the membrane, the membrane defining a front volume in front of the membrane and a rear volume behind the membrane, wherein the ring-shaped bead is arranged beneath the central portion and extends radially inwards starting from a coil seat of the coil, wherein the air gap is sealed by a liquid or solid medium disposed between an outer surface of the coil and an inner surface of the cup, the liquid or solid medium isolating the front volume from the rear volume of the transducer, and wherein an acoustic short circuit between the front volume and the rear volume of the transducer is prevented.

2. Electrodynamic acoustic transducer according to claim 1, wherein the coil, by projecting into the air gap, forms an inner and an outer air gap, and that the sealing medium seals either both air gaps or only the outer air gap.

3. Electrodynamic acoustic transducer according to claim 1, wherein the air gap is sealed by a ferrofluid.

4. Electrodynamic acoustic transducer according to claim 3, wherein the connection of the ring portion to the coil body is situated beneath the connection of the central portion to the coiled body.

5. Electrodynamic acoustic transducer according to claim 1, wherein the connection of the ring portion and the connection of the central portion are separated by the coil.

6. Electrodynamic acoustic transducer according to claim 1, wherein the central portion has at the perimeter a protruding edge which encircles the coil on the exterior side.

7. Electrodynamic acoustic transducer according to claim 3, wherein the ring portion is fastened to the coil on the inner side of the coil and/or on the underside of the coil.

8. Hearing aid with an electrodynamic acoustic transducer comprising:

a coil which projects into an air gap formed between an inner surface of a cup and a surface of a pole flange, the coil being subject to an electromagnetic field, wherein the electrodynamic transducer has a membrane including two differently profiled portions, namely an acoustically effective central portion with a convexity in form of a spherical caps and a ring-shaped bead which borders the central portion and serves to elastically support the membrane, the membrane defining a front volume in front of the membrane and a rear volume behind the membrane, wherein the ring-shaped bead is arranged beneath the central portion and extends radially inwards starting from a coil seat of the coil, wherein the air gap is sealed by a liquid or solid medium disposed between an outer surface of the coil and an inner surface of the cup, the liquid or solid medium isolating the front volume from the rear volume of the transducer, and wherein an acoustic short circuit between the front volume and the rear volume of the transducer is prevented.

9. Hearing aid according to claim 8, wherein the hearing aid has a moveable ear tube for fitting to the human auditory passage.

10. Headphones with an electrodynamic acoustic transducer comprising:

a coil which projects into an air gap subject to an electromagnetic field, wherein the electrodynamic transducer has a membrane comprising two differently profiled portions, namely an acoustically effective central portion with a convexity in form of a spherical cap, and a ring-shaped bead which borders the central portion and serves to elastically support the membrane, wherein the ring-shaped bead is arranged beneath the central portion and extends radially inwards starting from a coil seat of the coil, and wherein the air gap is sealed by means of a liquid or solid medium, such that an acoustic short circuit between the front volume and the rear volume of the transducer is prevented.

* * * * *